United States Patent [19]

Hendricks et al.

[11] 4,294,579

[45] * Oct. 13, 1981

[54] PROCESS FOR THE ONE-BATH, SINGLE-STAGE DYEING OR PRINTING OF CELLULOSE FIBRES WITH FIBRE-REACTIVE DISPERSE DYESTUFFS

[75] Inventors: Udo-Winifred Hendricks; Dietrich Hildebrand, both of Odenthal; Robert Kuth, Cologne, all of Fed. Rep. of Germany

[73] Assignee: Bayer Aktiengesellschaft, Leverkusen, Fed. Rep. of Germany

[ * ] Notice: The portion of the term of this patent subsequent to May 19, 1998, has been disclaimed.

[21] Appl. No.: 69,690

[22] Filed: Aug. 27, 1979

[30] Foreign Application Priority Data

Apr. 7, 1979 [DE] Fed. Rep. of Germany ..... 2914142

[51] Int. Cl.[3] ..... D06P 3/66; D06P 3/84

[52] U.S. Cl. ..... 8/549; 8/576; 8/609; 8/918

[58] Field of Search ..... 8/171, 54.2, 189, 84, 8/93, 173, 79, 163, 188, 1 D, 1 E, 549, 576, 609, 918

[56] References Cited

U.S. PATENT DOCUMENTS

| | | | |
|---|---|---|---|
| 3,791,787 | 2/1974 | Yamada et al. | 8/54.2 |
| 3,853,460 | 12/1974 | Balland | 8/84 |
| 3,923,457 | 12/1975 | Ong et al. | 8/93 |
| 3,945,793 | 3/1976 | Corbishuey et al. | 8/93 |
| 3,945,989 | 3/1976 | Angliker et al. | 260/197 |
| 3,980,426 | 9/1976 | Feess et al. | 81/173 |
| 4,115,053 | 9/1978 | Aeschlimann | 8/163 |
| 4,149,849 | 4/1979 | Koch et al. | 8/54.2 |

FOREIGN PATENT DOCUMENTS 1530104 10/1970 United Kingdom .

OTHER PUBLICATIONS

Translation Japan Kokai 78-143784 Publ. 12-14-78, Nose et al. "Process of Dyeing Active Hydrogen-Containing Fibers".

*Primary Examiner*—John C. Bleutge

*Attorney, Agent, or Firm*—Sprung, Felfe, Horn, Lynch & Kramer

[57] ABSTRACT

Padding liquors or printing pastes which contain at least one compound which is free from ionic groups and possesses one or more glycicyl radicals are used for the one-bath, single-stage dyeing and printing of textile sheet-like structures of cellulose fibres or fibre blends containing cellulose fibres with water-insoluble reactive disperse dyestuffs in the absence of alkalis or alkaline compounds.

3 Claims, No Drawings

PROCESS FOR THE ONE-BATH, SINGLE-STAGE DYEING OR PRINTING OF CELLULOSE FIBRES WITH FIBRE-REACTIVE DISPERSE DYESTUFFS

The invention relates to a one-bath, single-stage process for dyeing or printing cellulose fibres or textile sheet-like structures containing cellulose fibres with water-insoluble reactive dyestuffs in the absence of alkalis or alkaline compounds. The process is characterised in that padding liquors or printing pastes are used which contain at least one compound which is free from ionic groups and possesses one or more glycidyl radicals, and which have a pH value of between 7.5 and 2.7, especially between 7.0 and 3.5. The compounds possessing glycidyl groups are preferably water-soluble compounds which are liquid at room temperature and have a boiling point of not less than 220° C.

Particular mention should be made of compounds containing glycidyl groups, of the formula $$Z[Q]_p \qquad \text{(I)}$$

wherein

Q denotes a radical of the formula $$-(Y)_m-(O-CH_2-CH_2)_n-(O)_q-CH_2-\underset{\underset{O}{\diagup\diagdown}}{CH-CH_2},$$

Z denotes a monovalent to tetravalent aliphatic hydrocarbon radical which can be interrupted by S-atoms, a cycloaliphatic hydrocarbon radical, a saturated heterocyclic radical or the groups PO, $R_1-CO-N<$, $$R_1-CO-N\begin{matrix}\diagup\\ \diagdown R\end{matrix},\ R_1-SO_2-N\begin{matrix}\diagup\\ \diagdown\end{matrix},\ R_1-SO_2-N\begin{matrix}\diagup\\ \diagdown R\end{matrix},$$

$R_1-NH-CO-$ or $-OC-NH-A-NH-CO-$,

R denotes hydrogen or alkyl, $R_1$ denotes alkyl, cycloalkyl, aryl or aralkyl,

Y denotes a radical of the formula $-CO-CH_2-CH_2-SO_2-CH_2-CH_2-$ or $-CH_2-CH_2-$, A denotes alkylene or arylene, m denotes 0 or 1, n denotes 0–10, q denotes 0 or 1 and p denotes 1–4.

q only represents zero if m and n are zero and the glycidyl radical is bonded to a hetero-atom of Z.

If p represents 2–4, the substituents Q are bonded to different atoms of Z.

The bridge member Y is preferably bonded to a nitrogen atom of Z.

The aliphatic and cycloaliphatic hydrocarbon radicals are in particular optionally branched radicals with up to 8 C atoms.

Preferred aliphatic radicals Z and preferred alkyl radicals R and $R_1$ are those with 1–5 carbon atoms.

Preferred cycloaliphatic radicals Z and cycloalkyl radicals $R_1$ are the cyclopentyl and cyclohexyl radical.

Aryl and aralkyl in particular represent phenyl and benzyl respectively.

A for example represents a $C_2$–$C_6$-alkylene or a phenylene radical.

Examples of heterocyclic radicals Z are the 1,3,5-hexahydrotriazine radical or radicals of the formula

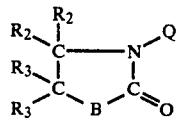

(II)

wherein $R_2$ represents hydrogen or the $R_2$'s conjointly represent oxygen, $R_3$ represents hydrogen or methyl and B represents

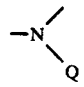

or $-CH_2-$, or the group

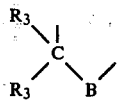

represents an o-phenylene radical.

Amongst the compounds of the formula I, those of the formula $$Z_1[(-O-CH_2-CH_2)_n-O-CH_2-\underset{\underset{O}{\diagup\diagdown}}{CH-CH_2}]_p \qquad \text{(III)}$$

wherein $Z_1$ denotes a monovalent to tetravalent aliphatic hydrocarbon radical with 1–5 carbon atoms, and n and p have the abovementioned meaning, those of the formula $$O=P[(-O-CH_2-CH_2)_n-O-CH_2-\underset{\underset{O}{\diagup\diagdown}}{CH-CH_2}]_3 \qquad \text{(IV)}$$

wherein n has the abovementioned meaning, and those of the formula $$Z_2[\{Y_1(O-CH_2-CH_2)_n-O-\}_{0\ or\ 1}-CH_2-\underset{\underset{O}{\diagup\diagdown}}{CH-CH_2}]_{p_1} \qquad \text{(V)}$$

wherein $Z_2$ denotes the 1,3,5-hexahydrotriazine radical or a radical of the formula II, $Y_1$ denotes $-CO-CH_2-CH_2-$ or $-SO_2-CH_2-CH_2-$ and $p_1$ denotes 1–3, n has the abovementioned meaning and the radical in square brackets is bonded to a nitrogen atom of $Z_2$ are preferred.

Examples of the compounds I are:

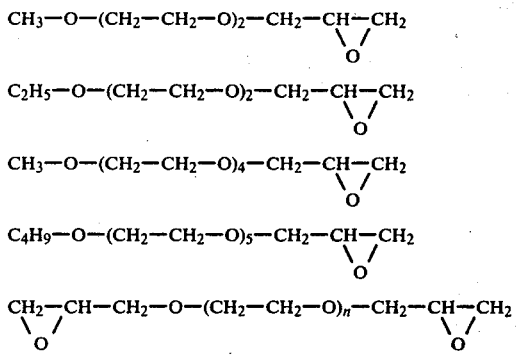
n = 0–8, especially 1–6
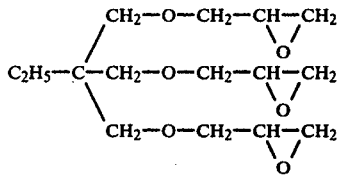
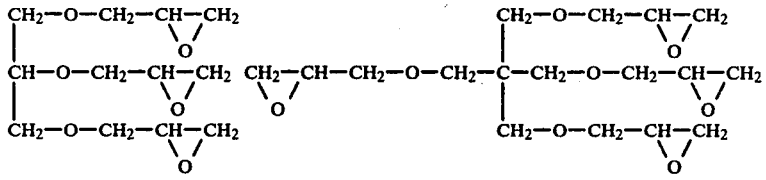
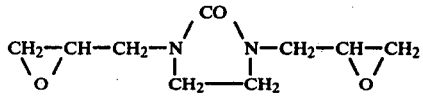
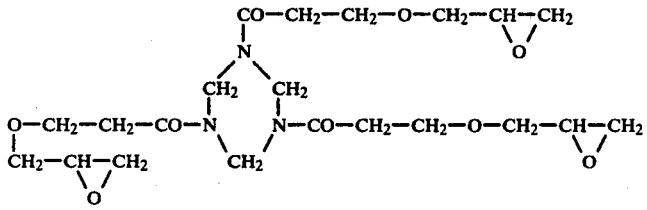
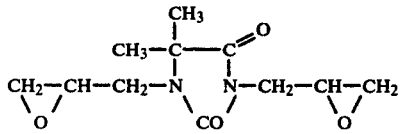
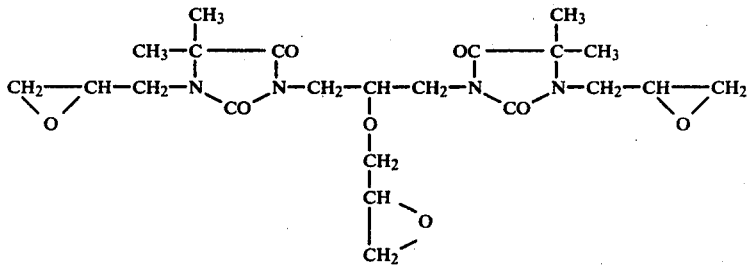
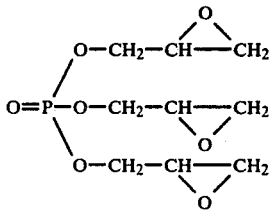

-continued

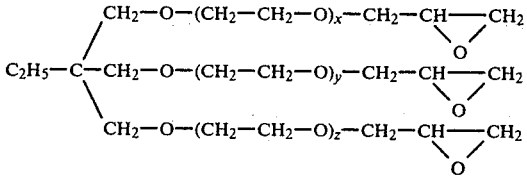

x,y,z = 1–10
x + y + z = 25

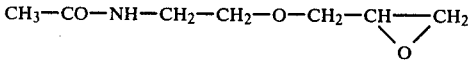

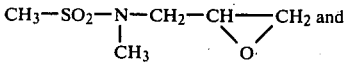

and

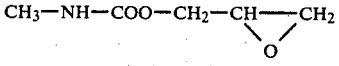

The water-insoluble reactive dyestuffs which can be employed in the process according to the invention are disperse dyestuffs, possessing at least one fibre-reactive group, from the category of the azo series and anthraquinone series. Suitable disperse dyestuffs, possessing at least one fibre-reactive group, which deserve particular mention are those having at least one halogenopyrimidyl or halogenotriazinyl group. Reactive dyestuffs which possess at least one 2,4-difluoro-5-chloro-pyrimid-6-yl group, a monofluoro-s-triazinyl group or a monofluoro-monochloro-pyrimidyl group have proved particularly suitable. These preferentially usable reactive dyestuffs are described, for example, in German Offenlegungsschrift (German Published Specification) No. 2,033,253 and in German Patent Application No. P 28 09 156.7.

Dyeing according to the process of the invention is effected by impregnating the textile materials, containing cellulose fibres, with the aqueous padding liquors in the usual manner, squeezing off to a weight increase of 40 to 100% and subjecting the material, if appropriate after brief intermediate drying, to a heat treatment at 190°–230° C. for about 30 to 90 seconds. For printing, the printing pastes are prepared using the conventional thickeners for reactive dyestuffs, such as alignates. The dyestuffs are fixed on the printed textile materials either by a dry heat treatment at 190°–230° C. for one to two minutes, or by high temperature steaming at 170°–210° C. for 2–15 minutes. Suitable textile materials are those of natural and regenerated cellulose and their blends with polyesters, for example poly(ethylene glycol terephthalate) or polyamides, for example from hexamethylenediamine and adipic acid, or polycaprolactam.

The amounts of epoxide compound I to be employed according to the process of the invention are between 2.5 and 100 g/l; amounts of between 2.5 and 50 g/l have proved advantageous. For dyeing or printing mixed textiles of cellulose fibres/poly(ethylene glycol terephthalate) or polyamide, the padding liquor or printing paste can also contain, in addition to the disperse reactive dyestuff to be used in accordance with the claims, a commercial disperse dyestuff which on heat-treating the textile material at 170°–230° C. as required by the process, gives a fast dyeing of the poly(ethylene terephthalate) constituent or polyamide constituent of the fibre mixture.

The padding liquor or printing paste can in addition contain up to 100 g/l, especially 20–60 g/l, of polyethylene glycol ethers and/or polypropylene glycol ethers.

German Offenlegungsschrift (German Published Specification) No. 2,033,253 and German Patent Application No. P 28 08 156.7 each describe processes for dyeing or printing textiles containing polyester or polyamide and/or cellulose with reactive disperse dyestuffs at temperatures above 150° C.

It is true that the processes described give strong dyeings on polyester and polyamide textile materials. However, in the case of pure cellulose textiles or of the cellulose component in textiles of polyester/cellulose or polyamide/cellulose mixtures the dyeing of the cellulose is relatively weak and requires improvement.

It has now been found, surprisingly, that with the epoxide compounds to be used according to the invention the fixing yield of reactive disperse dyestuffs on cellulose fibres, especially when these are mixed with polyester or polyamide fibres, can be substantially improved in the absence of alkalis. Reliable and reproducible dyeing of both fibre components of a mixture can thereby be achieved even when small amounts are employed.

The parts referred to in the examples which follow are parts by weight, unless stated otherwise. The formulae of the dyestuffs I to IX used in the examples are shown in the table which follows the examples.

EXAMPLE 1

A cotton fabric is padded with a padding liquor which contains 20 parts of the reactive disperse dyestuff I and 25 parts of the compound of the formula

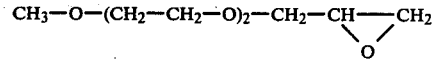

in 955 parts of water. The pH value of the padding liquor is 5.6. The fabric is squeezed off to a weight increase of 70%, dried for one minute at 130° C. and then subjected to a hot air treatment at 220° C. for one minute. The fabric is then rinsed cold for five minutes and warm for five minutes and is subsequently soaped at the boil for 5 minutes with a wash solution which contains 5 parts of a customary detergent per 1,000 parts, rinsed warm for 5 minutes and dried. An orange-red dyeing having excellent fastness characteristics is obtained.

If instead of the compound of the formula

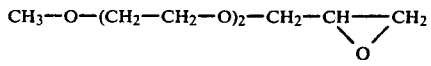

the same number of parts of the compound of the formula

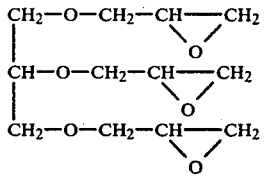

is used, a similar dyeing is obtained.

A similar dyeing is also obtained if instead of the compound of the formula

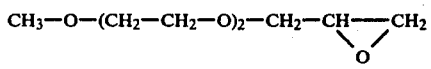

the same number of parts of the compound of the formula

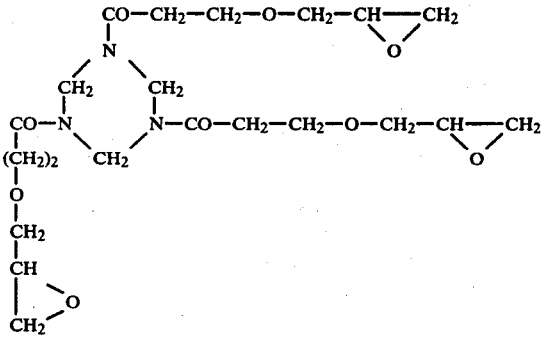

is used.

EXAMPLE 2

A mixed fabric consisting of 67 parts of poly(ethylene glycol terephthalate) and 33 parts of cotton is padded with a padding liquor which contains 70 parts of the reactive disperse dyestuff II and 30 parts of the compound of the formula

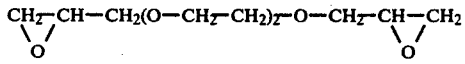

in 900 parts of water. The pH value of the padding liquor is 5.0. The fabric is squeezed off to a weight increase of 70% and then subjected to a hot air treatment at 220° C. for one minute. Thereafter the fabric is rinsed cold for five minutes and warm for five minutes and is subsequently soaped at the boil for 10 minutes with a wash solution which contains 5 parts of a customary detergent, for example a paraffinsulphonate, per 1,000 parts, rinsed warm for five minutes and dried. A clear blue dyeing having good fastness characteristics and good matching-shade dyeing of the two fibre components is obtained.

If instead of the compound of the formula

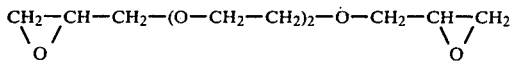

the same number of parts of the compound of the formula

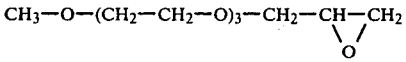

is used, a dyeing of equal strength is obtained.

EXAMPLE 3

A mixed fabric consisting of 67 parts of poly(ethylene glycol terephthalate) and 33 parts of cotton is printed with an aqueous printing paste which contains 60 parts of the reactive disperse dyestuff III, 450 parts of 4% strength aqueous alginate thickener, 50 parts of the compound of the formula

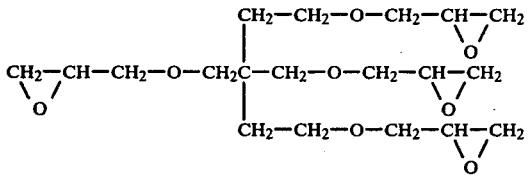

and 50 parts of polyethylene glycol in 1,000 parts, dried for 1 minute at 130° C. and then subjected to a hot air treatment at 220° C. for one minute. After thorough rinsing with cold and warm water, the fabric is soaped at the boil for 20 minutes with a solution which contains 1 part of a commercial paraffinsulphonate and 0.5 part of sodium carbonate in 1,000 parts, rinsed with warm water and dried. A deep red print with good matching-shade dyeing of the two fibre components is obtained, with excellent yield from the dyestuff.

EXAMPLE 4

A mixed fabric consisting of 67 parts of poly(ethylene glycol terephthalate) and 33 parts of cotton is printed with an aqueous printing paste which contains 40 parts of the reactive disperse dyestuff IV, 20 parts of the disperse dyestuff VI, 550 parts of a 4% strength aqueous alginate thickener and 50 parts of the compound of the formula

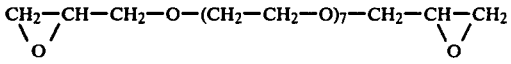

in 1,000 parts. The fabric is dried for two minutes at 80° C. and then treated for 1 minute with hot air at 220° C. After thorough rinsing with cold and warm water, the fabric is then soaped at the boil for 20 minutes with a solution which contains 1 part of a commercial paraffinsulphonate and 0.5 part of sodium carbonate in 1,000 parts, rinsed with clear water and dried. A deep red print with good matching-shade dyeing of the two fibre components is obtained, with excellent yield from the dyestuff.

EXAMPLE 5

A mixed fabric consisting of 67 parts of poly(ethylene glycol terephthalate) and 33 parts of cotton is padded with a padding liquor which contains 30 parts of the reactive disperse dyestuff V, 20 parts of the disperse dyestuff VIII, 10 parts of the compound of the formula

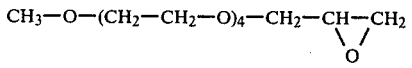

and 50 parts of polyethylene glycol in 890 parts of water, dried for 1 minute at 130° C. and then subjected to a hot air treatment at 200° C. for one minute. After thorough rinsing with cold and warm water, the fabric is soaped at the boil for 20 minutes with a solution which contains 1 part of a commercial paraffinsulphonate and 0.5 part of sodium carbonate in 1,000 parts, rinsed with warm water and dried. A clear yellow dyeing with good matching-shade dyeing of the two fibre components is obtained, with excellent yield from the dyestuff.

EXAMPLE 6

A mixed fabric consisting of 50 parts of viscose staple and 50 parts of polyamide is printed with an aqueous printing paste which contains 40 parts of the reactive disperse dyestuff of the formula IX, 20 parts of the disperse dyestuff VI and 40 parts of the compound of the formula

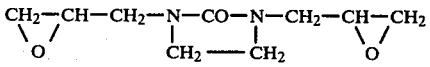

in 1,000 parts. The fabric is dried for 2 minutes at 80° C. and then steamed for 15 minutes with superheated steam at 180° C. After thorough rinsing with cold and warm water, the fabric is soaped at the boil for 20 minutes with a solution which contains 1 part of a commercial paraffinsulphonate and 0.5 part of sodium carbonate in 1,000 parts, rinsed with clear water and dried. A golden yellow print with good matching-shade dyeing of the two fibre components is obtained, with excellent yield from the dyestuff.

I

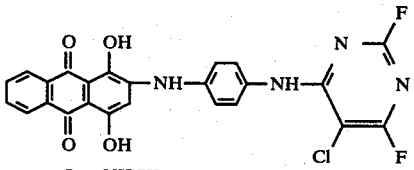

II

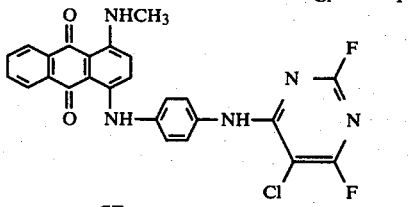

III

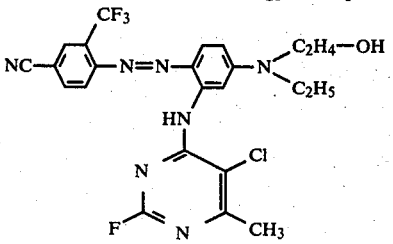

-continued

IV

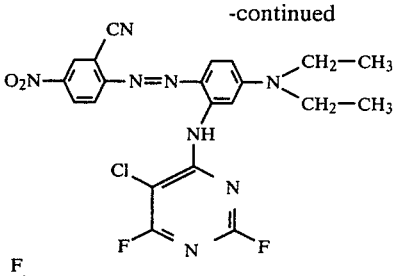

V

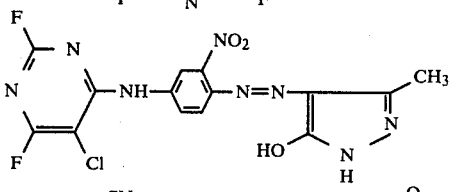

VI

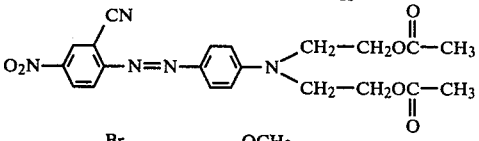

VII

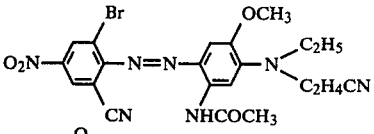

VIII

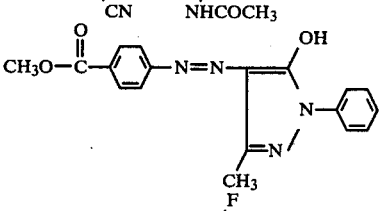

IX

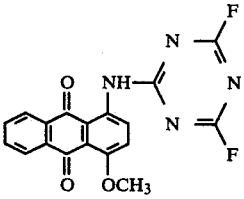

We claim:

1. In the dyeing and printing of fibres and textile materials containing cellulose wherein the fibres or textile materials are contacted with a padding liquor or printing paste containing a water-insoluble reactive disperse dyestuff in the absence of alkali or alkaline compounds, the improvement which comprises incorporating in the padding liquor or printing paste at least one compound of the formula

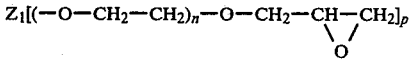

wherein $Z_1$ is a monovalent to tetravalent aliphatic hydrocarbon radical with 1-5 carbon atoms, n is 0-10, and p is 1-4.

2. A process according to claim 1, wherein the incorporated compound is of the formula

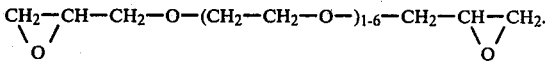

3. A process according to claim 1, wherein the reactive dyestuff is a disperse dye containing at least one fibre-reactive difluorochloropyrimidyl, monofluorochloropyrimidyl and/or monofluorotriazinyl group.

* * * * *